US008177668B2

(12) United States Patent
Matsubara

(10) Patent No.: US 8,177,668 B2
(45) Date of Patent: May 15, 2012

(54) DART

(75) Inventor: Hiroaki Matsubara, Touon (JP)

(73) Assignee: Cosmo Precision Machine, Inc., Touon-shi, Ehime-ken (JP)

( * ) Notice: Subject to any disclaimer, the term of this patent is extended or adjusted under 35 U.S.C. 154(b) by 201 days.

(21) Appl. No.: 12/553,148

(22) Filed: Sep. 3, 2009

(65) Prior Publication Data

US 2010/0062882 A1 Mar. 11, 2010

(30) Foreign Application Priority Data

Sep. 10, 2008 (JP) ..... 2008-231793

(51) Int. Cl.
*A63B 65/02* (2006.01)

(52) U.S. Cl. ..... 473/578

(58) Field of Classification Search ..... 473/578, 473/585, 586

See application file for complete search history.

(56) References Cited

U.S. PATENT DOCUMENTS

| | | | | | |
|---|---|---|---|---|---|
| 3,995,861 | A | * | 12/1976 | Clarke | 473/586 |
| 4,114,884 | A | * | 9/1978 | Tunnicliffe | 473/586 |
| 4,958,838 | A | * | 9/1990 | Farler | 473/586 |
| 4,978,130 | A | * | 12/1990 | Farler | 473/586 |
| 5,642,887 | A | * | 7/1997 | Orav | 473/586 |

FOREIGN PATENT DOCUMENTS

| | | | |
|---|---|---|---|
| GB | 2052277 | A | 1/1981 |
| GB | 2100994 | A | 1/1983 |
| GB | 2310809 | A | 9/1997 |
| JP | 1974-135200 | U1 | 11/1974 |
| WO | 2007/000983 | A1 | 1/2007 |

OTHER PUBLICATIONS

Japanese Office Action for Japanese Patent Application Serial No. 2008-231793, 3 pages.

Combined Search and Examination Report under Sections 17 and 18(3) in GB Patent Application No. GB0913738.1, dated Nov. 18, 2009, 5 pages.

* cited by examiner

*Primary Examiner* — John Ricci

(74) *Attorney, Agent, or Firm* — JTT Patent Services, LLC; Gerald T. Peters

(57) ABSTRACT

The present invention provides a dart having a durable and break-resistant structure. A dart in accordance with an embodiment of the present invention has, in order from the front thereof, a tip, a barrel, a shaft, and a flight. At the rear of the shaft, a cap-receiving portion having a diameter smaller than that existing elsewhere is formed, this cap-receiving portion being capable of receiving a cap-like portion of the flight. At the front end of the flight, a hollow cylindrical cap-like portion containing a hole for attachment to the cap-receiving portion of the shaft is formed. The shaft and the flight are connected to each other by a sliding engagement method.

1 Claim, 3 Drawing Sheets

DART

BACKGROUND OF THE INVENTION

1. Field of the Invention

The present invention relates to a dart for use in the game of darts, a sport in which arrow-like projectiles called darts are thrown at a target called a dartboard that is mounted on a wall or the like so that players can compete for the highest score.

2. Description of the Related Art

A dart is constructed by connecting component parts including, in order from the front, a pointed tip, a barrel, a shaft, and a flight. The tip at the front end is the part which hits the target. In the case of a hard dart, the tip is made of metal. In the case of a soft dart, the tip is made of plastic. The barrel serves as the body of the dart. When a player throws a dart, the player usually holds the barrel. The shaft, being the part to which the flight is attached, has a large effect on the stability of the dart while in flight.

Examples of conventional darts include darts disclosed in Japanese Utility Model Registration Application No. 3118732, Japanese Unexamined Patent Application Publication No. 2008-093153, and Japanese Unexamined Patent Application Publication No. 2008-142399.

In a conventional dart, the shaft and the flight are connected to each other by inserting the fins of the flight in slits formed in the shaft. This being the case, the slits are formed in the shaft in a cruciform arrangement as viewed in a plane perpendicular to the axial direction, the four fins of the flight being spaced at angular intervals of 90° about the axis so as to impart the dart with a cruciform profile as viewed in a plane perpendicular to the axial direction.

The shaft and the flight are formed using polypropylene (PP) or the like as the material. Since the thickness of the fins of the flight is very thin, being about 0.3 mm to 0.5 mm, the fins might for example be manufactured from four sheets of plastic film that each form one side of a pair of facing surfaces of neighboring fins.

Because the conventional dart described above is manufactured by a method in which the front end of the flight is inserted into slits in the shaft, a stepped region is inevitably formed at the boundary region where the shaft and the flight are mutually connected.

Generally, in a darts game, there is a case that, in a state where a dart thrown first hits the dartboard, the next dart is thrown and, sometimes, the next dart hits the dart already stuck in the dartboard. In a case where a front end of the tip hits the stepped region in the boundary between the shaft and the flight, a large stress is applied to both of the darts by the collision. When such a collision is repeated, the darts may be broken due to fatigue. In particular, because the portion at the boundary between the shaft and the flight is made narrow by presence of the four slits in the shaft, this portion is easily broken.

This is particularly true in the case of a hard dart, which might have a tip made of steel or other metal. In the event that a dart already stuck in the dartboard is hit from behind by such a dart, a very large stress will be applied to the stepped region in the boundary between the shaft and the flight, and there is the possibility that the dart will be broken easily. When a dart is broken due to collision as described above, this will of course negatively impact the player involved from an economic viewpoint.

SUMMARY OF THE INVENTION

The present invention having been conceived to solve the foregoing problem, it is an object of the invention to provide a dart having a durable and break-resistant structure.

To solve the problem, the present invention provides a dart having, in order from the front thereof, a tip, a barrel, a shaft, and a flight. In the dart, a hollow cylindrical cap-like portion for attachment to the rear of the shaft is formed at the front of the flight, and the shaft and the flight are connected to each other by a sliding engagement method.

The present invention can provide a dart having a durable and break-resistant structure.

DETAILED DESCRIPTION OF PREFERRED EMBODIMENT

Figure 1:
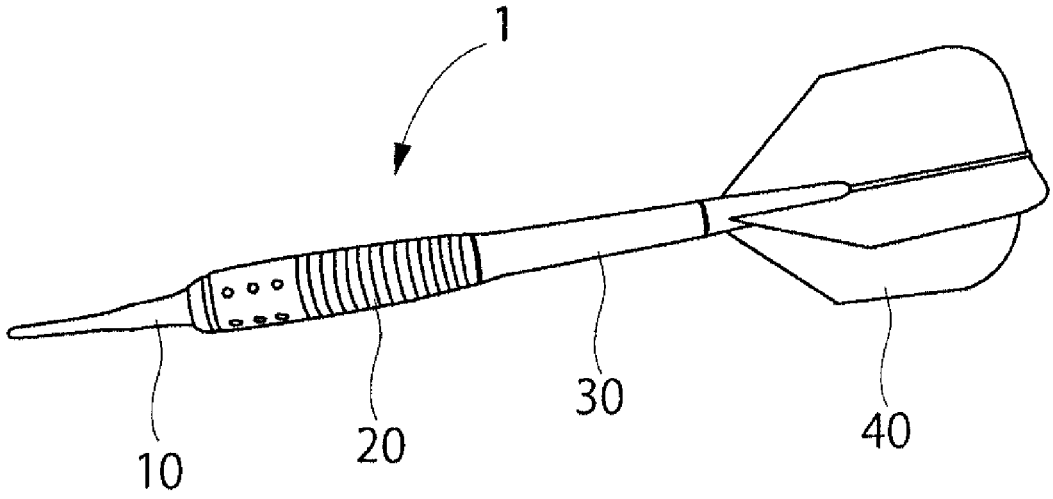
FIG. 1 is a perspective view of a dart in accordance with an embodiment of the present invention.

An embodiment of the present invention will be described in detail hereinbelow with reference to the drawings. The present embodiment is characterized by employing a configuration of a sliding engagement method to attach a flight to a shaft. FIG. 1 is a perspective view showing the configuration of a dart of the embodiment.

As shown in FIG. 1, a dart 1 includes, in order from the front end thereof at the left side of the drawing, a tip 10, a barrel 20, a shaft 30, and a flight 40. As the material of the tip 10, commonly available plastics such as polyethylene (PE), polypropylene (PP), or the like may be used. As the material of the barrel 20, nickel, tungsten, or other such high-density metal may be used.

Figure 2:
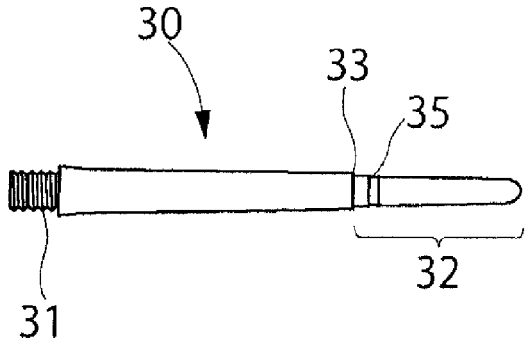
FIG. 2 is a plan view of a shaft in the embodiment.

FIG. 2 is a plan view of the shaft in the embodiment. As shown in the drawing, a threaded portion 31 capable of being screwed into an appropriately threaded portion at the rear of the barrel 20 is formed at the front (left side in the drawing) of the shaft 30. At the rear (right side in the drawing) of the shaft 30, a cap-receiving portion 32 having a diameter smaller than that existing elsewhere is formed, this cap-receiving portion 32 being capable of receiving a cap-like portion 42 of the flight 40, described below. The cap-receiving portion 32 has a shape that tapers slightly as one goes toward the rear.

At the front end of the cap-receiving portion 32, a step 33 is formed that is capable of abutting the end face at the front end of the flight 40. At a location slightly rearward from the step 33, a groove 35 is formed circumferentially in a plane perpendicular to the axis. The groove 35 is formed such that the concavity thereof has radius of curvature R=0.5 mm as viewed in a plane containing the axis of the shaft 30.

As the material of the shaft 30, a synthetic resin such as polypropylene (PP), polyamide (PA), polystyrene (PS), polycarbonate (PC), or polyacetal (POM), or a metal such as aluminum, may be used. Where a synthetic resin is used, the shaft 30 is preferably integrally formed by injection molding.

Figure 3:
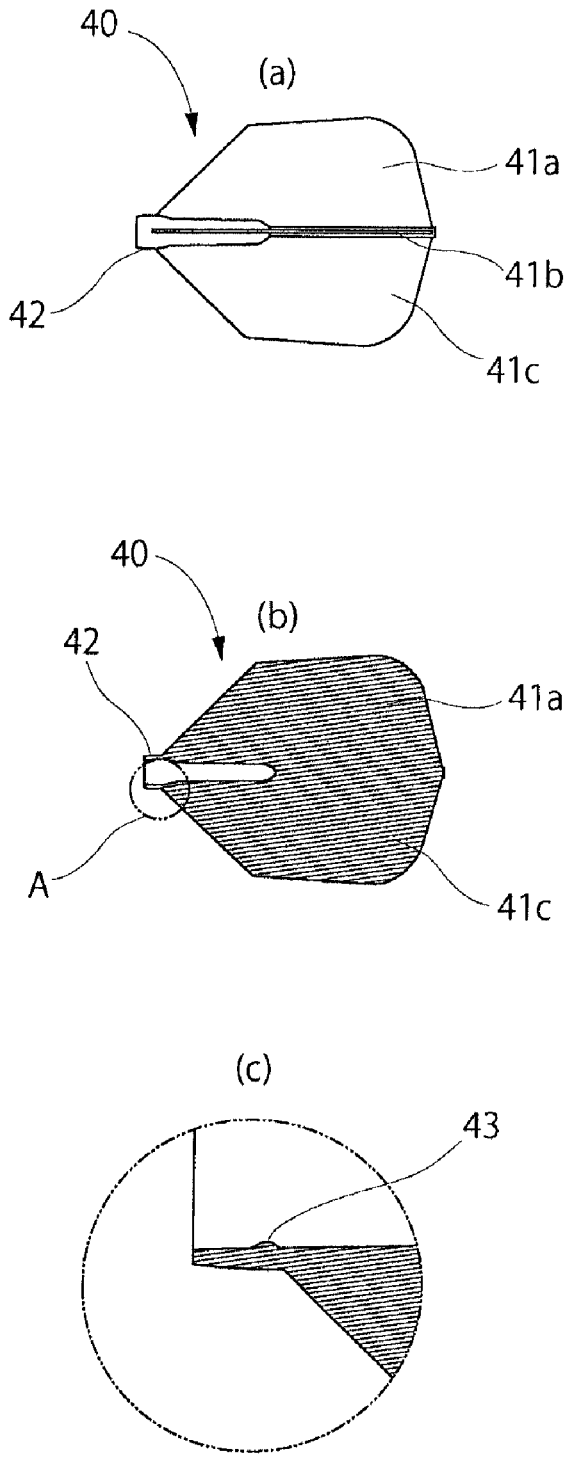
FIG. 3 shows the configuration of a flight in the embodiment.
Figure 4:
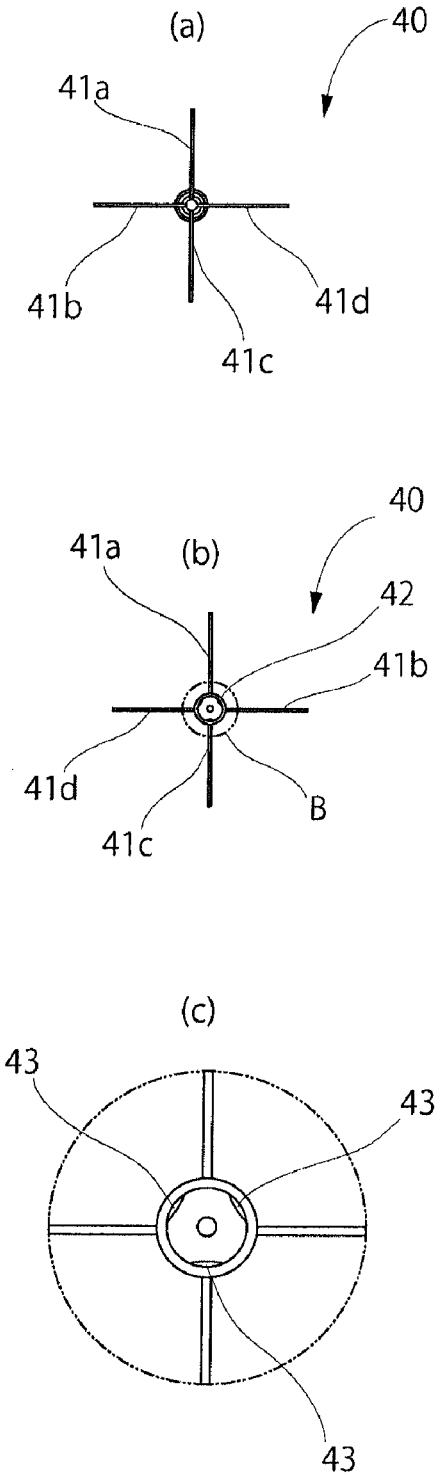
FIG. 4 shows the configuration of the flight in the embodiment.

FIG. 3(*a*) through (*c*) and FIG. 4(*a*) through (*c*) are views showing the configuration of the flight in the embodiment. FIG. 3(*a*) is a plan view of the flight, FIG. 3(*b*) is a cross section of the flight, and FIG. 3(*c*) is an enlarged view of the location indicated with reference numeral A in FIG. 3(*b*). FIG. 3(*b*) is a cross section of the flight in a plane containing the axis of the dart 1 and parallel to fins 41*a* and 41*c*, described below. FIG. 4(*a*) is a right side view of the flight, FIG. 4(*b*) is a left side view of the flight, and FIG. 4(*c*) is an enlarged view of the location indicated with reference numeral B in FIG. 4(*b*).

As shown in FIG. 3(*a*) through (*c*) and FIG. 4(*a*) through (*c*), the flight 40 has four fins 41*a* through 41*d* provided at angular intervals of 90° about the axis, and has a hollow cylindrical cap-like portion 42 containing a hole capable of engaging with the cap-receiving portion 32 of the shaft 30 so as to mutually connect the shaft 30 and the flight 40. The hole of the cap-like portion 42, provided at the front end of the flight 40, is formed so that, as shown in FIG. 3(*b*), its diameter decreases slightly in correspondence to the shape of the cap-receiving portion 32 of the shaft 30 as one goes toward the interior thereof. That is, as can be seen at FIGS. 1, 3, and 4, in the present embodiment, a plurality of fins 41*a* through 41*d* are attached to and extend radially outward from the exterior of the hollow cap-like portion 42, being separated from the interior of the hollow cap-like portion 42 by a stem having a wall thickness that, as can be seen at FIG. 3(*b*), is less than the largest inside diameter of the hollow cap-like portion 42.

As shown in FIG. 3(*c*) and FIG. 4(*c*), at the inside surface at a region that is slightly (about 2 mm) inward from the opening of the hole of the cap-like portion 42, three projections 43 are formed at intervals of 120° about the axis. When mutually connecting the shaft 30 and the flight 40, the projections 43 are made to engage with the groove 35 in the shaft 30, causing the cap-like portion 42 of the flight 40 to be firmly attached thereto so as not to easily come off from the shaft 30. That is, as will be understood by comparing FIGS. 2 and 3, which show the situation before engagement, and FIG. 1, which shows the situation after engagement, the flight 40 including integral fins 41*a* through 41*d* can be connected in endwise fashion to the shaft 30 in a single motion by a sliding engagement method. Furthermore, in the present embodiment, it is clear from comparison of FIGS. 1 and 2 that when the flight 40 is thus connected to the shaft 30, the rearmost portion of the shaft 30 is at least partially housed within the stem portion of the flight 40 from which the fins 41*a* through 41*d* extend radially outward. More specifically, in the present embodiment, as can be seen from comparison of FIGS. 1 and 2, in connecting the flight 40 to the shaft 30, the rearmost portion of the shaft 30 is aligned in coaxial fashion with the stem of the flight 40, and as the two are brought together a point will be reached at which their axes mutually overlap; and when fully engaged, the rearmost edge of the shaft 30 (e.g., the portion of the shaft 30 at far right in FIG. 2) will in the present embodiment extend to a location that is rearward of the frontmost edges of fins 41*a* through 41*d* (e.g., the leftmost apex of the fin visible in FIG. 1).

As shown in the cross section of FIG. 3(*c*), the cross-sectional profile of each of the projections 43 in a plane parallel to the axis is such that the portion to the front of the apex thereof makes a gentle transition, having radius of curvature R=0.5 mm, while the portion to the rear of that apex makes a more abrupt transition, having radius of curvature R=0.35 mm. Consequently, the cap-like portion 42 can be installed by causing the gently sloped surface on the R=0.5 mm side of the projection 43 to come into contact with the surface of the cap-receiving portion 32, and carrying out sliding engagement against this gently sloped surface. In contrast, the cap-like portion 42 cannot be detached without causing the comparatively abruptly sloped surface on the R=0.35 side to abut the edge of the groove 35 (having R=0.5). Thus, a configuration such that the flight 40 does not easily come off from the shaft 30 is made possible.

As the material of the flight 40, a synthetic resin such as polypropylene (PP), polyamide (PA), polystyrene (PS), or the like is used. The flight 40 is integrally formed by injection molding. The fins 41*a* through 41*d* are thus integral with the stem portion of the flight 40, the stem portion opening at the tip side thereof to present hollow cap-like portion 42 for attachment to the cap-receiving portion 32 of the rear of the shaft 30.

Since the dart 1 as the embodiment of the present invention specifically described above does not have the conventional configuration in which the fins of the flight are inserted in slits in the shaft, the outer surface of the cap-like portion 42 of the flight 40 can be formed smoothly without generating a stepped region at the boundary between the shaft 30 and the flight 40 that would otherwise be apparent as viewed from the rear (back). Therefore, an inconvenience in which the front tip of a later-thrown dart hits a stepped region between the shaft and the flight of a dart already stuck in the dartboard can be prevented.

Furthermore, with the conventional insertion method, because a thin fin of the flight had to be inserted in a narrow slit in the shaft, it was sometimes the case that the flight could not be easily attached to the shaft, and moreover, repeated attempts to insert the flight thereinto often resulted in damage to the thin fins of the flight. In contrast, the dart 1 of the embodiment employs the sliding engagement method, making it possible for anyone to easily slidably engage the cap-like portion 42 of the flight 40 onto the cap-receiving portion 32 of the shaft 30.

Moreover, with the conventional insertion method, since slits had to be formed in the shaft, a synthetic resin had to be used for the shaft at the time of molding. In contrast, with the sliding engagement method in accordance with the embodiment described above, there is no particular objection to employment of a metal such as aluminum or tungsten as the material of the shaft. Thus, the embodiment described above makes it possible through use of a simple configuration to provide a dart having a durable and break-resistant structure.

Next, an embodiment providing a free-spinning flight 40, in the context of a structure that permits the flight 40 to be freely rotatable relative to the shaft 30 through clever exploitation of a difference between the molding shrinkage ratios of the materials employed in the shaft 30 and the flight 40, will be described. Here, taking the case where both the shaft 30 and the flight 40 are injection-molded from synthetic resins, use of a synthetic resin having a relatively high molding shrinkage ratio as the material of the shaft 30 and use of a synthetic resin having a relatively low molding shrinkage ratio as the material of the flight 40 will conveniently permit manufacture of a free-spinning flight 40 capable of being rotatably connected to the shaft 30.

For example, in one embodiment, polyacetal (POM) might be used as the material of the shaft 30, and polypropylene (PP) having a shrinkage ratio lower than that of POM might be used as the material of the flight 40. Given a design in which the cap-receiving portion 32 of the shaft 30 had otherwise been intended to receive the cap-like portion 42 of the flight 40 such that the shaft 30 and the flight 40 would be fixed in relation to each other, the exemplary combination of materials given above will result in a situation in which the shaft 30 shrinks slightly more than the flight 40 following injection molding due to the difference in shrinkage ratios. Consequently, this allows convenient manufacture of a free-spinning flight 40 in which the flight 40 and the shaft 30 can be mutually connected while permitting relative rotation about the axis.

In the present embodiment, the flight 40 and the shaft 30 are mutually connected by the sliding engagement method, not by the conventional insertion method. By using the difference between the molding shrinkage ratios of materials, a free-spinning flight 40 can be conveniently manufactured in which the flight 40 is connected to the shaft 30 while permitting relative rotation about the axis. With a free-spinning flight 40 in which the flight 40 is rotatable about the axis of the shaft 30, if a later-thrown dart hits the fins of the flight of a dart that is already stuck in a dartboard, the flight is able to rotate so that collision can be avoided. Thus, breakage of the dart can be prevented.

Obviously, the combination of the materials is not limited to the above-described exemplary combination. For example, similar effects can also be produced with a combination of polypropylene (PP) for the shaft 30 and polyamide (PA) for the flight 40, or a combination of polyamide (PA) for the shaft 30 and polystyrene (PS) for the flight 40.

Furthermore, a free-spinning flight 40 in which the shaft 30 and the flight 40 are relatively rotatable about the axis may be manufactured not only by exploiting a difference in molding shrinkage ratios but also by setting the size of the cap-like portion 42 of the flight 40 to be slightly larger (by about 0.01 mm) than that of the cap-receiving portion 32 of the shaft 30 at the time of designing. In particular, when using a metal as the material of the shaft 30, since the shrinkage ratio of the metal is zero, the size has to be changed from the designing stage.

Although one or more embodiments of the present invention have been described in detail above, the present invention is not limited to the foregoing embodiments but can be variously modified without departing from the scope of the present invention. For example, in an embodiment described above a groove was formed on the shaft and projections were provided on a cap-like portion of the flight for firm connection so that the flight does not come off of the shaft, but it is also possible to provide projections on the shaft and provide the groove on the flight.

What is claimed is:

1. A dart comprising, in order from the front thereof, a tip, a barrel, a shaft, and a flight, wherein a hollow cylindrical cap-like portion for attachment to the rear of the shaft is formed at the front of the flight, the flight including a plurality of integral fins being capable of being connected in endwise fashion to the shaft in a single motion by a sliding engagement method;

a groove is formed in a circumferential direction in one of the rear of the shaft or a hole in the hollow cylindrical cap-like portion, and at least one projection is formed on the other;

the at least one projection engages with the groove when the shaft and the flight are mutually connected;

the at least one projection has a first radius of curvature on a side thereof which contacts the groove as the shaft and the flight are being mutually connected, and a second radius of curvature on a side thereof which contacts the groove as the shaft and the flight are being mutually disconnected; and the first radius of curvature is substantially larger than the second radius of curvature.

* * * * *